United States Patent [19]

Grunert et al.

[11] 4,099,151

[45] Jul. 4, 1978

[54] ELECTROMAGNETIC CONTACTOR

[75] Inventors: Kurt A. Grunert, Beaver; John P. Conner, Brighton Township, Beaver County; Stephen S. Dobrosielski, Beaver, all of Pa.

[73] Assignee: Westinghouse Electric Corp., Pittsburgh, Pa.

[21] Appl. No.: 782,478

[22] Filed: Mar. 29, 1977

[51] Int. Cl.[2] ..... H01H 3/46

[52] U.S. Cl. ..... 335/189; 335/133; 335/200

[58] Field of Search ..... 335/189, 190, 191, 128, 335/132, 133, 202, 203, 200

[56] References Cited

U.S. PATENT DOCUMENTS

| | | | |
|---|---|---|---|
| 3,032,627 | 5/1962 | Ronk | 335/200 |
| 3,033,957 | 5/1962 | Dean, Jr. | 335/133 |
| 3,156,797 | 11/1964 | Smith | 335/133 |
| 3,275,775 | 9/1966 | Hawkins | 335/133 |
| 3,659,237 | 4/1972 | Wilsdon et al. | 335/128 |

*Primary Examiner*—Harold Broome
*Attorney, Agent, or Firm*—L. P. Johns

[57] ABSTRACT

An electromagnetic contactor characterized by a stationary contact structure, a movable contact structure, the movable contact structure comprising a contact arm and a conductor, and a shuntless, pivotal electrical connection between the contact arm and the conductor.

7 Claims, 4 Drawing Figures

ELECTROMAGNETIC CONTACTOR

BACKGROUND OF THE INVENTION

1. Field of the Invention

This invention relates to an electromagnetic contactor and, more particularly, it pertains to a shuntless, pivotal electrical connection.

2. Description of the Prior Art

The joint constructions of movable contact members of contactors of prior construction have usually included a shunt to maintain electrical continuity between a contact arm and an adjacent stationary conductor. A disadvantage of a shunt is its relatively short life compared to other parts of a contactor.

Associated with the foregoing is a need for a high contact force in order to reduce heating and to reduce contact bounce for better utilization of contact button material and longer endurance life, which in turn result in lower energy loss and reduced enclosure cooling effect.

SUMMARY OF THE INVENTION

An electromagnetic contactor comprising an insulating housing, a stationary contact structure within the housing, a movable contact structure within the housing and movable between open and closed positions relative to the stationary contact structure, support means for supporting the movable contact structure and pivotally mounted for movement between said positions, a coil spring for holding the support means in the open position, electromagnetic means comprising a magnetic armature, a magnetic core, and a coil for actuating the support means to the closed position, the magnetic armature being on the support means and the core being on the housing, the movable contact structure comprising a contact arm and a conductor, a shuntless, pivotal, electrical connection between the contact arm and the conductor, the shuntless, pivotal, electrical conductor having a center of rotation on the pivotal axis of the support means, second bias means disposed between the support means in the contact arm for retaining the contact arm in pivotal, electrical connection with the conductor, and the shuntless, pivotal, electrical connection comprising an outturned projection on the contact arm and a projection-receiving V-notch on the conductor, and the projection and V-notch having pivotally contacting surfaces extending perpendicular to the plane of rotation of the contact arm.

In another embodiment the shuntless, pivotal, electrical connection comprises a pair of arcuate contacting portions, one portion being on the contact arm and the other portion being on the conductor, and the center of rotation of the arcuate contacting portions being on the pivotal axis of the support means.

The advantage of the device of this invention is the elimination of a relatively short-lived shunt and a provision of a higher contact force for reduced heating and better utilization of contact button material.

DESCRIPTION OF THE PREFERRED EMBODIMENT

Figure 1:
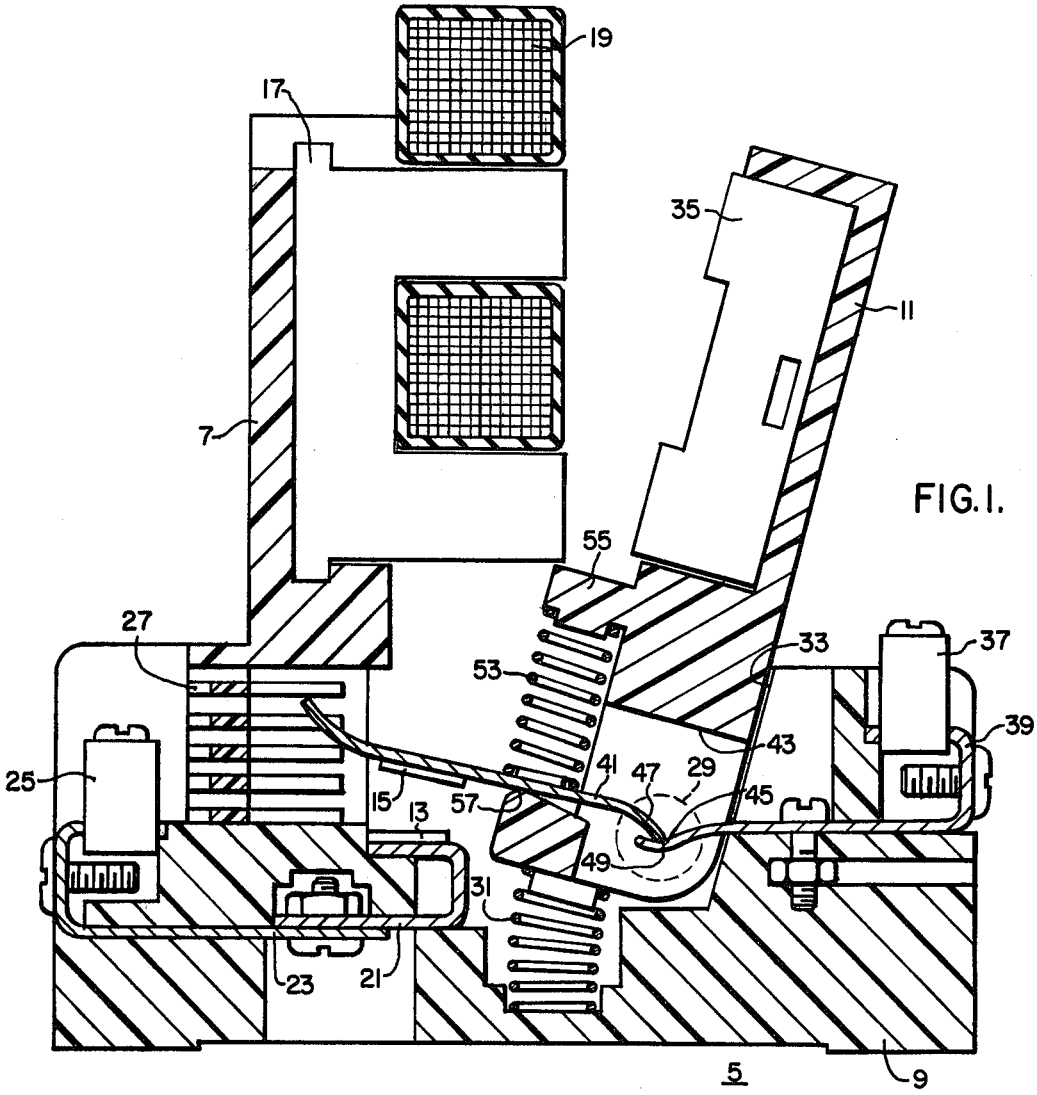
FIG. 1 is vertical sectional view of an electromagnetic contactor in the contact open position.

In FIG. 1 the contactor is generally indicated at 5 and it comprises a housing 7 including a base 9, a cross bar 11, stationary contact 13, and movable contact 14. The housing 7 preferably comprises two portions including the base and the upright position which are detachably secured together by suitable means such as bolts (not shown). The housing 7 and the base 9 are composed of electrically insulating material, such as glass filled polyester, and the upright portion supports a magnetic core 17 and a coil 19. The magnetic core 17 is a U-shaped member comprised of core windings in a conventional manner. The housing 7 also encloses the contacts 13, 15, the former of which is mounted on a conductor 21 which is connected to a line conductor 23 leading to a line terminal 25. An arc chute 27 is disposed near the contacts 13, 15 in a conventional manner.

The cross bar 11 is pivotally mounted on trunnions 29 which extend from opposite sides into the base 9. Bias means, such as a coil spring 31, are provided to the left of the trunnions 29, as viewed in FIG. 1, to rotate the cross bar 11 counterclockwise against a surface 33 of the base 9.

An armature 35 is mounted on the upper portion of the cross bar 11 and cooperates with the electromagnetic 17 to move the cross bar 11 counterclockwise in response to an electromagnetic force created in the magnet by the coil 19.

A load terminal 37 is mounted on the base 9 and is connected to a terminal conductor 39, the left end of which is electrically connected to a movable contact arm 41. For that purpose an opening 43 is provided in the lower end of the cross bar 11.

In accordance with this invention the terminal conductor 39 comprises a V-notch portion 45. The movable contact arm 41 comprises a downturned portion or projection 47 which is pivotally supported in the V-notch 45 at 49 which is located at the axis of rotation of the trunnions 29, and therefore of the support means or cross bar 11.

The movable contact arm 41 is also supported on a portion 51 of the cross bar 11 where the arm is secured in place by bias means such as a coil spring 53. The upper end of the spring 53 is supported by a portion 55 of the cross bar 11. Thus the spring 53 is disposed between the contact arm 41 and the portion 55 of the cross bar. The undersurface of the contact arm 41 is thereby secured at a surface position 57 of the portion 51 which position 57 is slightly to the left of the axis of the spring 53 to thereby hold the projection 47 in constant contact at the pivotal support 49 of the V-notch portion 45 of the conductor 39.

Figure 2:
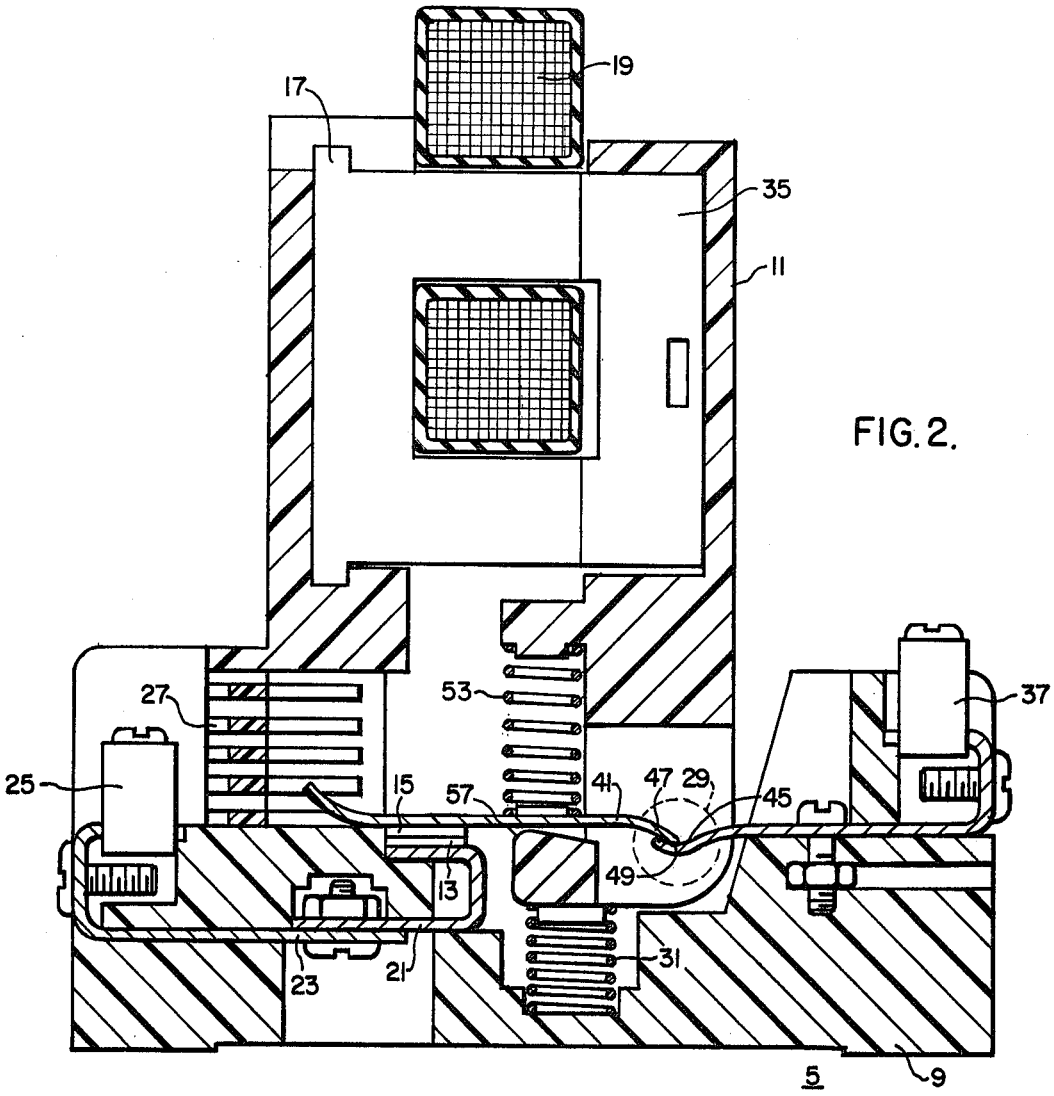
FIG. 2 is a view similar to FIG. 1 showing the contactor in the contact closed position.

In operation, when the coil 19 is actuated an electromagnetic flux, created in the magnetic core 17, attracts the armature 35 to rotate the cross bar 11 to the position shown in FIG. 2. As a result, the force of the spring 31 is overcome and the contacts 13, 15 are closed. The coil spring 53, being disposed between the contact 15 and the pivotal support 49, holds the contact arm 41 tightly in place between those locations with the portion 51 of the cross bar being displaced below the contact arm.

Figure 3:
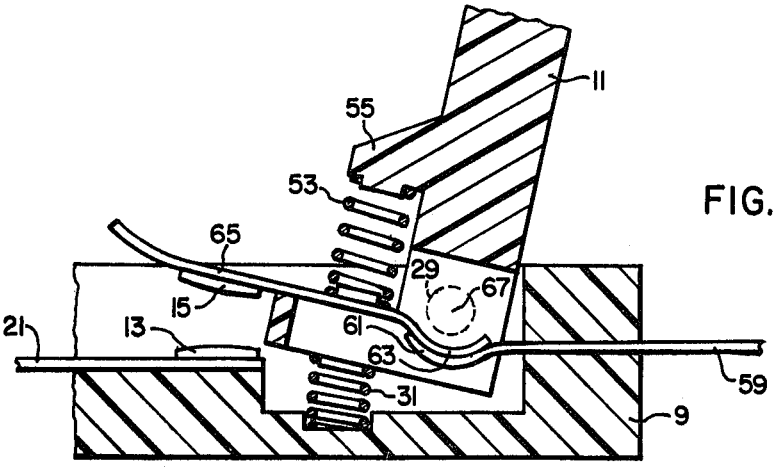
FIG. 3 is a fragmentary sectional view of another embodiment of the invention.

Another embodiment of the invention is shown in FIG. 3 in which similar numerals refer to similar parts of the embodiment shown in FIGS. 1 and 2. In FIG. 3 a terminal conductor 59 includes an arcuate end portion 61 which is concentrically disposed and in contact with an arcuate end portion 63 of a movable contact arm 65. The center of rotation of the arcuate end portions 61, 63 is the center of rotation 67 of the trunnions 29 of the cross bar 11. Accordingly, when the cross bar is rotated from the open to the closed contact position, the mating surfaces of the arcuate end portions 61, 63 rotate in good electrical contact with each other to maintain a circuit between the conductors 21 and 59 and through the closed contacts 13, 15.

Figure 4:
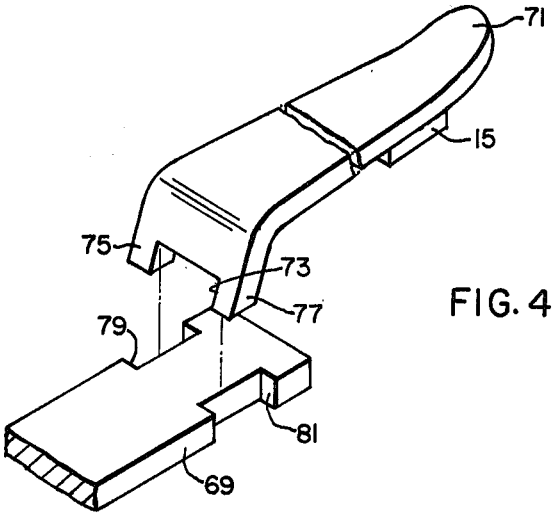
FIG. 4 is a view showing still another embodiment of the invention.

Still another embodiment of the invention is shown in FIG. 4 in which a load conductor 69 functions with a movable contact arm 71. As shown in the exploded positions of the conductor and arm, the arm 71 includes a notch 73 formed by spaced portions 75, 77 which when assembled with the conductor 69 are disposed in notches 79, 81, respectively, of the conductor. Thus when assembled the movable contact arm 71 and the load conductor 69 are pivotally engaged in good electrical contact with each other in a manner similar to that of the embodiment shown in FIGS. 1 and 2.

Accordingly, the device of this invention provides a shuntless, pivotal, electrical connection between a movable contact arm and an electrical conductor which connection eliminates the need for the conventional shunt as provided in circuit interrupters of prior construction.

What is claimed is:

1. An electromagnetic contactor comprising an insulating housing, a stationary contact structure within the housing, a movable contact structure within the housing and movable between open and closed positions relative to the stationary contact structure, support means for supporting the movable contact structure and pivotally mounted for movement between said positions, first bias means for holding the support means in one of said positions, electromagnetic means comprising a magnetic armature, a magnetic core, and a coil for actuating the support means to the other of said positions, one of the magnetic armature and the core being on the housing and the other of them being on the support means, the movable contact structure comprising a contact arm and a conductor, and a shuntless, pivotal, electrical connection between the contact arm and the conductor.

2. The electromagnetic contactor of claim 1 in which the shuntless, pivotal, electrical connection has a center of rotation on the pivot axis of the support means.

3. The electromagnetic contactor of claim 2 in which second bias means are disposed between the support means and the contact arm for retaining the contact arm in pivotal, electrical connection with the conductor.

4. The electromagnetic contactor of claim 3 in which the shuntless, pivotal, electrical connection comprises an outturned projection on one of the contact arms and the projection and a projection-receiving V-notch on the other of them, the projection and the V-notch having pivotally contacting surfaces extending perpendicular to the plane of rotation of the contact arm.

5. The electromagnetic contactor of claim 4 in which the V-notch is on the conductor.

6. The electromagnetic contactor of claim 4 in which the pivotally contacting surfaces are on the pivotal axis of the support means.

7. The electromagnetic contactor of claim 3 in which the shuntless, pivotal, electrical connection comprises a pair of arcuate contacting portions, one portion being on the contact arm and the other portion being on the conductor, and the center of rotation of the arcuate contacting portions being on the pivotal axis of the support means.

* * * * *